United States Patent [19]

Satterfield

[11] Patent Number: 4,811,434

[45] Date of Patent: Mar. 14, 1989

[54] SPA WITH AN IMPROVED AIR CHANNEL AND METHOD FOR CONSTRUCTING SAME

[75] Inventor: Donald D. Satterfield, Oklahoma City, Okla.

[73] Assignee: Kimstock, Inc., Santa Ana, Calif.

[21] Appl. No.: 58,522

[22] Filed: Jun. 5, 1987

[51] Int. Cl.[4] ..... A61H 33/02

[52] U.S. Cl. ..... 4/543; 4/541; 4/542; 4/492; 128/66; 156/60

[58] Field of Search ..... 4/543, 492, 422, 544, 4/541, 542, 506; 128/66; 29/157.5; 156/1, 60, 228

[56] References Cited

U.S. PATENT DOCUMENTS

| | | | |
|---|---|---|---|
| 1,896,938 | 2/1933 | Borowsky | 4/543 |
| 2,856,611 | 10/1958 | Velonis | 4/543 |
| 3,693,194 | 9/1972 | Schindler et al. | 4/492 |
| 3,952,338 | 4/1976 | Troxclair | 4/542 X |
| 3,978,886 | 9/1976 | Mathis | 4/492 X |
| 4,000,528 | 1/1977 | Posnick | 4/584 |
| 4,008,498 | 2/1977 | Thomas | 4/543 |
| 4,101,988 | 7/1978 | Sierant | 4/543 |
| 4,110,852 | 9/1978 | Kline | 4/492 |
| 4,142,337 | 3/1979 | Holcomb | 4/492 X |
| 4,166,296 | 9/1979 | Darrah et al. | 4/543 |
| 4,213,210 | 7/1980 | Scourtes | 4/543 |
| 4,237,562 | 12/1980 | DuPont | 4/543 |
| 4,420,846 | 12/1983 | Bonner | 4/542 |
| 4,546,505 | 10/1985 | Wakenshaw | 4/543 |

*Primary Examiner*—Henry J. Recla
*Assistant Examiner*—Ernest G. Cusick
*Attorney, Agent, or Firm*—Dunlap, Codding & Peterson

[57] ABSTRACT

A spa having a base with an upper and a lower surface and a plurality of base air holes formed through predetermined portions of the base, and an air channel connected to the lower surface of the base for channeling air through the base air holes. The air channel consists of a tube having a tube opening extending therethrough and a plurality of tube air holes. The tube is disposed on the base so that each of the tube air holes is aligned with one of the base air holes. The tube is connected to the base and a seal is formed generally about each of the base air holes and aligned tube air holes between the tube and the lower surface of the base. A blower is connected to the tube in communication with the tube opening for blowing air through the tube opening and through the tube air holes and the aligned base air holes.

5 Claims, 2 Drawing Sheets

SPA WITH AN IMPROVED AIR CHANNEL AND METHOD FOR CONSTRUCTING SAME

BACKGROUND OF THE INVENTION

Field of the Invention

The present invention relates generally to spas and, more particularly, but not by way of limitation, to a spa with an improved air channel and method for constructing same.

PREFERRED EMBODIMENTS

Figure 1:
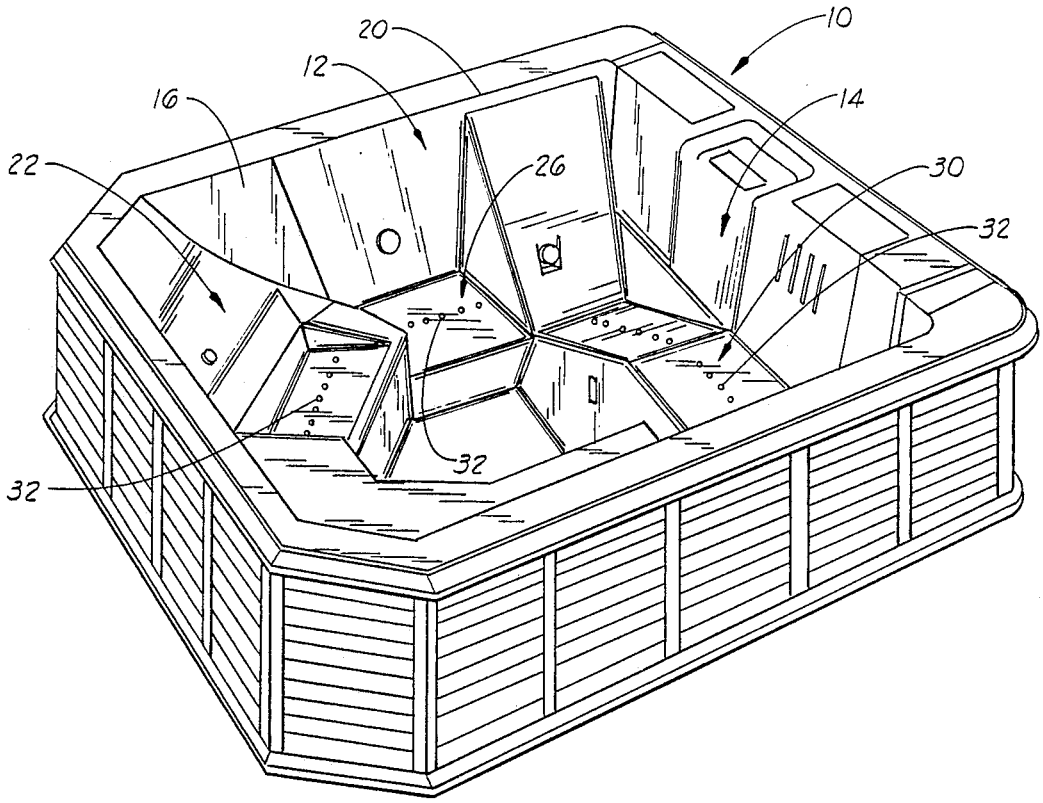
FIG. 1 is a top, partial perspective view of a spa.

Shown in FIG. 1 is a spa 10 having a base 12 with a retaining area 14 being formed in the base 12, the base 12 generally surrounding the retaining area 14 with an open upper end for providing access to the retaining area 14. The base 12 is constructed and adapted to retain water generally within the retaining area 14 and to accommodate individuals seated generally within the retaining area 14. Jets are connected to the base 12 in communication with the remaining area 14 for blowing air into the retaining area 14 for circulating the water disposed in the retaining area 14.

in operation, the retaining area 14 is filled with water and an individual is seated or otherwise disposed generally within the retaining area 14, and air is pumped through the jets causing the water to be circulated in predetermined patterns for therapeutic and recreation purposes. Spas of this generally type just described are well known in the art and commercially available from AquaSpa, a Division of KimStock, Inc., the assignee of the present invention.

Figure 2:
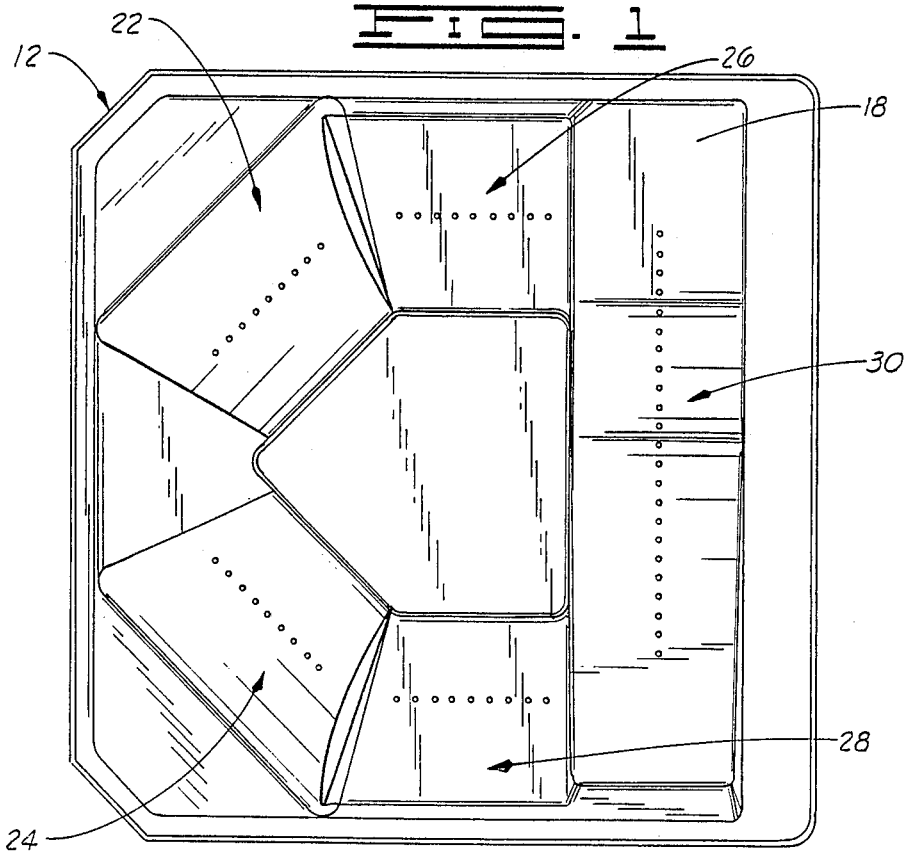
FIG. 2 is a bottom, partial perspective view of the base of the spa, shown in FIG. 1 without the air channel connected thereto, but with the initial base air holes formed therein.
Figure 3:
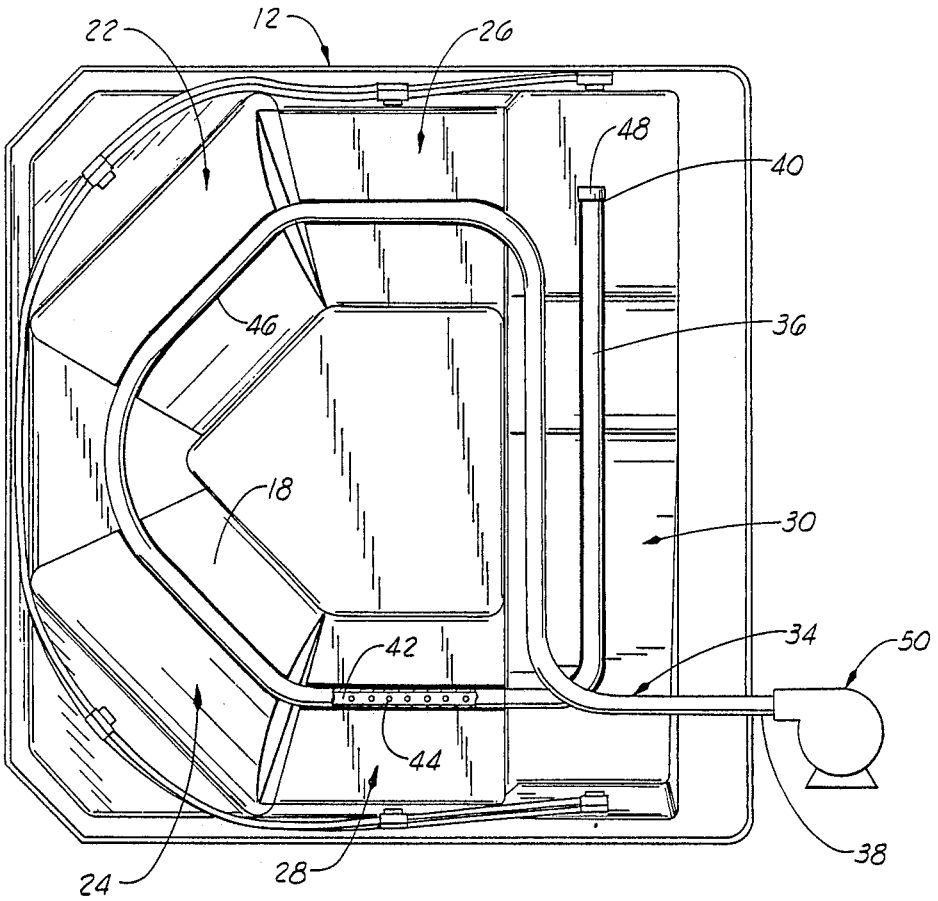
FIG. 3 is a bottom, partial perspective view of the base of the spa, similar to FIG. 2, but showing the air channel secured to the base, a portion of the air channel being cut-away to show the tube air holes.

The base 12 has an upper surface 16 (shown in FIG. 1) and a lower surface 18 (shown in FIGS. 2 and 3). The retaining area 14 is formed in the base and the upper surface 16 of the base 12 generally surrounds a portion of the retaining area 14, an open upper end 20 being provided to permit access to the retaining area 14.

The base 12 depicted in the drawings is a molded, one piece construction and a pair of bucket seats 22 and 24 are formed in the base 12. Also, a pair of bench seats 26 and 28 are formed in the base 12 and a lounge seat 30 also are formed in the base 12. The seats 22, 24, 26, 28 and 30 each are shaped so that an individual can sit generally on the seating area provided by the seats 22, 24, 26, 28 and 30 within the retaining area 14 of the base 12. Bases, such as the base 12, may be formed with various seating areas provided and aranged generally within the reatining area 14, and the seats 22, 24, 26, 28 and 30 are shown in FIGS. 1, 2, and 3 merely for illustrative purposes.

As shown more cearly in FIG. 2, a plurality of base air holes 32 are formed through the base 12, each of the base air holes 32 intersecting the upper and the lower surfaces 16 and 18 of the base 12, only some of the base air holes 32 being designated by a reference numeral in FIG. 2 for clarity. The base air holes 32 are spaced a distance apart and the base air holes 32 are located at predetermined positions on the base 12. In one preferred embodiment, as shown in FIG. 2, the base air holes 32 are located in the seating area formed by the seats 22, 24, 26, 28 and 30. It should be noted that the base air holes 32 preferably are formed through bottom portions of the base 12, rather than through the sides of the base 12 for reasons to be made more apparent below.

As shown in FIG. 3, the spa 10 also includes an air channel 34 which is connected to the lower surface 18 of the base 12. The air channel 34 is positioned and shaped to channel air through the base air holes 32 during the operation of the spa 10.

The air channel 34 includes a tube 36 (shown in FIG. 3) having opposite ends 38 and 40 and a tube opening 42 extending a distance therethrough. A plurality of tube air holes 44 are formed through the tube 36 and each of the tube air holes 44 is in communication with the tube opening 42, only some of the tube air holes 44 being shown in FIG. 3 and only some of the tube air holes 44 shown in FIG. 3 being designated therein specifically by a reference numeral for clarity.

The tube 36 is disposed on the lower surface of the base 12 and the tube 36 is positioned on the base 12 so that each of the tube air holes 44 is aligned with one of the base air holes 32 and, in this position, the tube 36 is secured to the lower surface 18 of the base 12 with an adhesive 46 which is also capable of forming a water seal generally about the base air holes 32 and the tube air holes 44 and between the lower surface 18 of the base 12 and the adjoining portions of the tube 36. Adhesives capable of connecting the tube 36 to the base 12 and capable of performing the sealing function mentioned before are commercially available, and one such suitable adhesive is commercially available from Industrial Polychemical Service of Gardena, Calif. 90247 sold under the mark Weld-On #10, for example.

A cap 48 is secured over the end 40 of the tube 36 thereby closing the tube opening 42 generally at the end 40 and forming a closed end 40 of the tube 36. The cap 48 is sealingly secured to the tube 36. The closed end 40 of the tube 36 may be formed in various manners and the cap 48 is shown in the drawings as only one example of such a closure. However, it is significant to note that the end 40 of the tube 16 is closed thereby closing the tube opening 42 generally at the end 40 of the tube 36.

The end 38 of the tube 36 is connected to a blower 50, schematically shown in FIG. 3. The blower 50 is adapted to blow air into the end 38 of the tube 36 and through the tube opening 42 in an activated or "on" condition of the blower 50 during the operation of the spa 10. More particularly, the blower 50 blows air through the tube opening 42, through the tube air holes 44 and through the aligned base air holes 32, thereby blowing air into the water in the retaining area 14 by way of the base air holes 32. The blowing of air into the water and the retaining space 14 through the base air holes 32 causes a bubbling effect through the water in the retaining area 14 with the bubbles coming from the base air holes 32 in the seat areas formed by the seats 22, 24, 26, 28 and 30 and bubbling upward toward the upper surface of the water during the operation of the spa 10.

Air holes, similar to the base air holes 32, also could be formed through the sides of the base 12 and connected to the blower 50 by way of the air channel 34 in a manner exactly like that described before with respect to the base air holes 32. However, the resulting bubbles would tend to travel only along the sides of the base 12 and the resulting effect would not be as esthetically pleasing as the resulting bubble effect provided by disposing the base air holes 32 along the portion of the base 12.

The preferred way of constructing the air channel 34 is to first drill initial the base air holes 32 in the base 12 with these initial base air holes 32 being slightly undersized (having a smaller diameter) as compared to the desired size or diameter of the base air holes 32 in the final product. After these intial base air holes 32 have been drilled in the base 12, the adhesive 46 is applied to the lower surface 18 of the base 12 generally about the initial base air holes 32 and, then, the tube 36 is pressed into the adhesive and centered over the initial base air holes 32. Screws (not shown) are then driven through each of the initial base air holes 32 and through the tube 36 thereby forming the tube air holes 44 and simultaneously pulling the tube 36 into position generally adjacent the lower surface 18 of the base 12, the screws holding the tube 36 in this position until the adhesive dries. The screws are sized to form the larger diameter base air holes 32 as the screws are driven through the initial base air holes 32 an dthrough the tube 36 to form the tube air holes 44. After the glue dries, the screws are removed from the base air holes 32 and the tube air holes 44 thereby leaving the tube 36 connected to the lower surface 18 of the base 12 with each of the base air holes 32 being aligned with one of the tube air holes 44.

The driving of the screws through the initial base air holes 32 and through the tube 36 forms the base air holes 32 and forms the tube air holes 44. Since the base air holes 32 and the tube air holes 44 are formed simultaneously after the tube 36 has been positioned adjacent the lower surface 18 of the base 12, each base air hole 32 automatically is aligned with one of the tube air holes 44.

The adhesive 46 acts not only to secure the tube 36 to the lower surface 16 of the base 12, but, also the adhesive 46 also acts or functions to form a seal about each of the base air holes 32 and the aligned tube air holes 44 generally between the base 12 and the adjacent portion so the tube 36.

The air channel 34 constructed in accordance with the present invention provides a seamless air channel 34 for blowing air through the base air holes 32 which virtually is leak proof.

The tube 36 has been shown in the drawings as having a generally circularly shaped cross-section. However, the tube 36 could have a square cross-section or a cross-section of some other shape if desired in a particular application.

Changes may be made in the construction and the operation of the various elements, components and assemblies described herein and changes may be made in the steps or sequence of steps of the methods described herein without departing from the spirit and scope of the invention as defined in the following claims.

What is claimed is:

1. A method for constructing an air channel comprising a tube having opposite ends and a tube opening for a spa having a base with an upper surface and a lower surface, the method comprising the steps of:

forming initial base air holes through the base at predetermined positions in the base with each base air hole intersecting the upper and the lower surfaces of the base;

disposing an adhesive generally over the lower surface of the base about each of the initial base air holes;

disposing the tube, on the lower surface of the base extending generally over each of the initial base air holes with the adhesive being disposed generally between the tube and the lower surface of the base; and forming a base air hole through each of the initial base air holes, each base air hole having a diameter slightly larger than the diameter of the initial base air holes, and forming tube air holes in the tube, each of the tube air holes being aligned with one of the base air holes, the adhesive connecting the tube to the lower surface of the base and forming a seal generally about each of the base air holes and aligned tube air holes and generally between the lower surface of the base and the tube.

2. The method of claim 1 defined further to include the step of:

connecting a blower to one end of the tube with the blower being in communication with the tube opening for blowing air through the tube opening and through the tube air holes and the aligned base air holes.

3. The method of claim 2 defined further to include the step of:

closing the tube opening generally at one end of the tube, opposite the end of the tube connected to the blower.

4. The method of claim 1 wherein the base has seats with seating areas provided therein, and wherein the step of forming the base air holes is defined further as forming the base air holes in the seating areas of the seats.

5. The method of claim 1 wherein the base has a bottom, and wherein the step of forming the base air holes is defined further as forming the base air holes in the bottom of the base.

* * * * *